US006707245B2

(12) United States Patent
Daiku et al.

(10) Patent No.: US 6,707,245 B2
(45) Date of Patent: Mar. 16, 2004

(54) GLASS PANEL FOR CATHODE RAY TUBE

(75) Inventors: Nobutaka Daiku, Otsu (JP); Hajime Makio, Otsu (JP); Yoshiharu Miwa, Otsu (JP)

(73) Assignee: Nippon Electric Glass Co., Ltd., Shiga-ken (JP)

( * ) Notice: Subject to any disclaimer, the term of this patent is extended or adjusted under 35 U.S.C. 154(b) by 17 days.

(21) Appl. No.: 10/200,052

(22) Filed: Jul. 19, 2002

(65) Prior Publication Data

US 2004/0012324 A1 Jan. 22, 2004

(51) Int. Cl.[7] ..... H01J 31/00
(52) U.S. Cl. ..... 313/477 R; 313/461
(58) Field of Search ..... 313/461, 477 R, 313/478, 479, 462, 402, 408, 407

(56) References Cited

U.S. PATENT DOCUMENTS 5,814,933 A 9/1998 Iwata et al. ..... 313/477 R
5,962,964 A * 10/1999 Sano et al. ..... 313/440
6,407,494 B1 * 6/2002 Maehara et al. ..... 313/461
6,417,613 B1 7/2002 Kyono ..... 313/477 R
6,448,706 B1 * 9/2002 Kawamura et al. ..... 313/477 R
6,472,805 B1 * 10/2002 Nakagawa et al. ..... 313/402
6,515,410 B2 * 2/2003 Sakamoto et al. ..... 313/414
2002/0017851 A1 2/2002 Watanabe et al. ..... 313/408

FOREIGN PATENT DOCUMENTS

DE 199 59 694 A1 6/2000
EP 1 089 313 A2 4/2001

* cited by examiner

*Primary Examiner*—Tuyet T. Vo
(74) *Attorney, Agent, or Firm*—J.C. Patents

(57) ABSTRACT

A glass panel for a cathode ray tube comprises a substantially rectangular face portion on which images are displayed and a skirt portion continuous to the face portion through a blend R portion. An effective screen size of the face portion in a diagonal direction is 500 mm or more, an average radius of curvature of an outer surface of the face portion is 10000 mm or more in all radial directions from a face center portion, and a difference in height between the face center portion and an edge portion of the effective screen in the diagonal direction on an inner surface of the face portion is in a range from 9 mm to 17 mm.

2 Claims, 5 Drawing Sheets

GLASS PANEL FOR CATHODE RAY TUBE

BACKGROUND OF THE INVENTION

The present invention relates to a glass panel that constitutes a cathode ray tube used to a television, display tube or the like.

Typically, as shown in FIG. 5, a glass bulb for a cathode ray tube comprises a front glass panel 1 on which images are displayed, a funnel 2 which is sealingly coupled to the glass panel 1 at the back thereof and externally provided with a deflection yoke, and a neck 3, welded to the funnel 2, for accommodating an electron gun therein.

For a color cathode ray tube, the glass panel 1 and the funnel 2 are sealingly coupled to and thus integrated with each other at their seal end surfaces 11 and 21 with a frit glass 4 disposed therebetween. In addition, since the cathode ray tube is internally exhausted to a high degree of vacuum for operation, the glass bulb is subjected to vacuum stress due to the difference in pressure between the inside and outside of the glass bulb.

Therefore, the glass bulb is designed to have a shape and thickness sufficiently enough to bear the vacuum stress caused by the difference in pressure between the inside and outside of the glass bulb. In particular, the glass panel 1 which is susceptible to external impacts was made thick in thickness, and among other things, a face portion 12 was made thick in thickness at edge portions of an effective screen thereof to disperse and thereby alleviate the vacuum stress.

However, when the glass panel is simply made thicker in thickness, the conventional glass panel for a cathode ray tube increases in its weight. This caused a tendency to worsen its ease of handling and workability, and increase the manufacturing costs thereof with regard to glass material.

The larger the effective screen size in a diagonal direction of the face portion of the glass panel, and the larger the average radius of curvature on the outer surface of the face portion, that is, the higher in the degree of flatness, the more the weight increases synergistically. Accordingly, the aforementioned tendency becomes more noticeable.

Additionally, X-rays may be produced in the cathode ray tube when the fluorescent substance coated on the inner surface of the glass panel is excited with electron beams to emit light. The glass panel is required of a predetermined capability of absorbing X-rays to prevent the leakage of the X-rays out of the cathode ray tube through the glass bulb, which would otherwise have an adverse influence on the human body.

SUMMARY OF THE INVENTION

It is therefore an object of the present invention to provide especially a large-sized glass panel, incorporated into a cathode ray tube, having an outer surface of a face portion with a high degree of flatness, in which the glass panel is reduced in weight and has a predetermined capability of sufficiently absorbing X-rays while maintaining a predetermined mechanical strength.

To achieve the foregoing object, the present invention provides a glass panel for a cathode ray tube comprising a substantially rectangular face portion on which images are displayed, and a skirt portion continuous to the face portion through a blend R portion. In this constitution, an effective screen size of the face portion in a diagonal direction is 500 mm or more, an average radius of curvature of an outer surface of the face portion is 10000 mm or more in all radial directions from a face center portion, and a difference in height between the face center portion and an edge portion of the effective screen in the diagonal direction on an inner surface of the face portion is in a range from 9 mm to 17 mm.

In the above-mentioned constitution, it is preferred that an X-ray absorption coefficient A ($cm^{-1}$) of the glass panel at a wavelength of 0.06 nm satisfy a condition of $A \geqq 1750\ t/D$, where D (mm) is the effective screen size of the face portion in the diagonal direction, t (mm) is a thickness at the face center portion.

The present invention intends particularly the glass panel for a cathode ray tube having a large-size in which the effective screen size of the face portion in the diagonal direction is 500 mm or more, and also having a high degree of flatness in which the average radius of curvature of the outer surface of the face portion is 10000 mm or more in all radial directions from the face center portion. Then the present invention provides the optimum range from 9 mm to 17 mm of the difference in height between the face center portion and the edge portion of the effective screen in the diagonal direction on the inner surface of the face portion, from the viewpoints of mechanical strength and reduction in weight of the glass panel.

In a case where the difference in height between the face center portion and the edge portion of the effective screen in the diagonal direction on the inner surface of the face portion is less than 9 mm, a so-called arch effect is not sufficient which is provided by increasing the difference in height from the face center portion to the edge portion of the effective screen (by increasing the thickness). Since it is necessary to be thick in thickness from the face center portion to maintain a predetermined mechanical strength, the glass panel cannot be made light in weight.

On the other hand, in a case where the difference in height between the face center portion and the edge portion of the effective screen in the diagonal direction on the inner surface of the face portion is more than 17 mm, a sufficient arch effect is obtained, thereby making it possible to make the thickness thin at the face center portion. However, even in this case, since a certain thickness is required to maintain a predetermined mechanical strength, the glass panel cannot be made light in weight, neither.

In a case where the entire glass panel is reduced in weight by providing the optimum range of the difference in height as described above so that there may be a possibility of an X-ray leakage due to a reduced thickness of the face center portion, the X-ray absorption coefficient of the glass panel can be made such that $A \geqq 1750\ t/D$, thereby making it possible to satisfy the predetermined capability of absorbing X-rays. On the other hand, there is a possibility for the glass panel to dissatisfy an X-ray leakage dosage of 36 pA/kg defined under the EIAJ standards (ED2113A) when the condition is $A < 1750\ t/D$.

DETAILED DESCRIPTION OF THE PREFERRED EMBODIMENTS

Embodiments of a glass panel for a cathode ray tube according to the present invention will be explained below in more detail with reference to FIGS. 1 to 4.

Figure 1A:
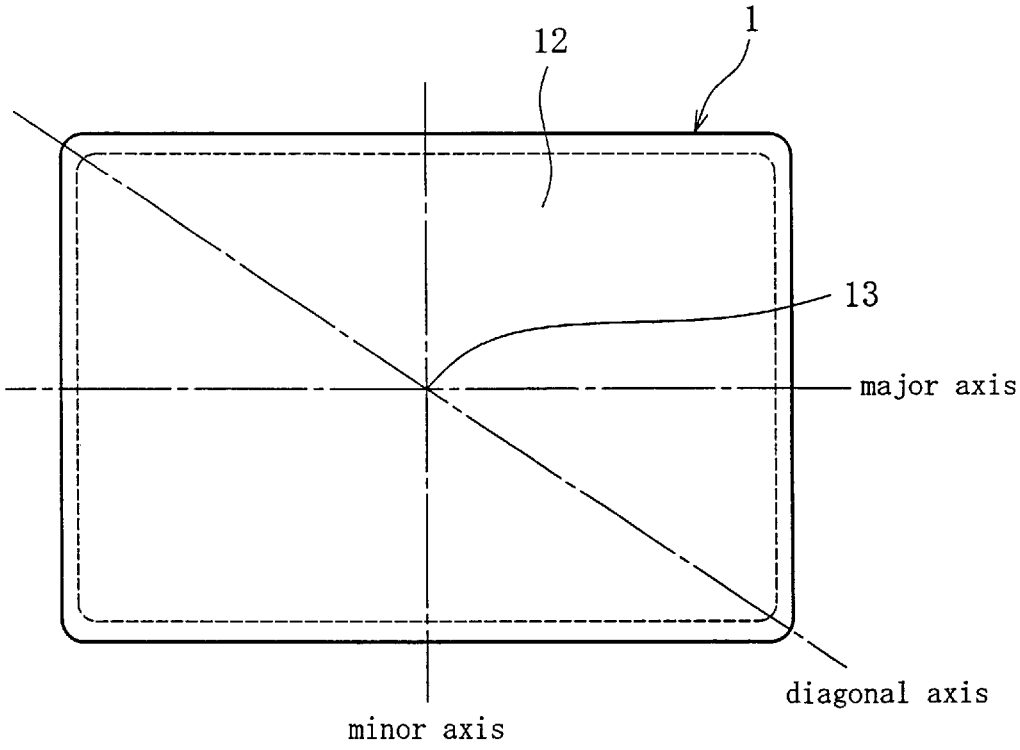
FIG. 1(*a*) is a plan view illustrating a glass panel for a cathode ray tube according to an embodiment of the invention, and FIG. 1(*b*) is a sectional view taken along a diagonal axis of the glass panel.
Figure 1B:
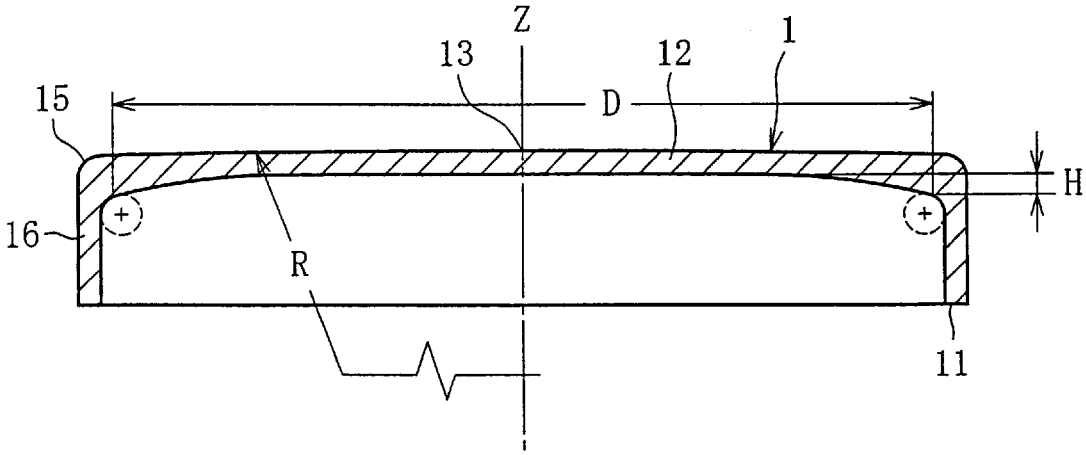

As shown in FIG. 1, a glass panel 1 for a cathode ray tube comprises a substantially rectangular face portion 12 on which images are displayed, and a skirt portion 16 continuous to the face portion 12 through a blend R portion 15. In the figure, D is the effective screen size of the face portion 12 in a diagonal direction, R is the average radius of curvature of the outer surface of the face portion 12, and H is the difference in height between a face center portion 13 of the inner surface of the face portion 12 and the edge portion of the effective screen.

Figure 2:
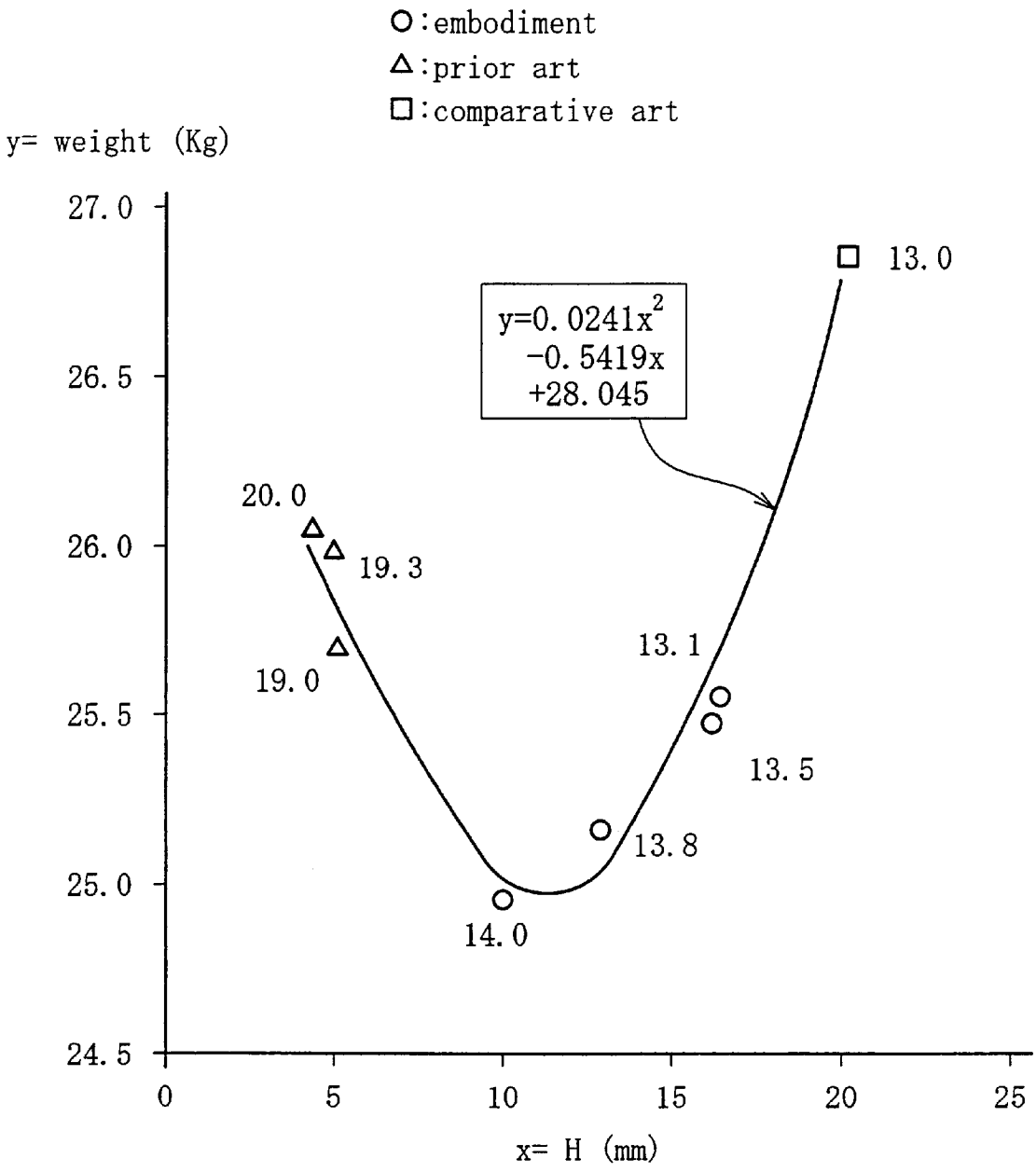
FIG. 2 is an explanatory graph showing the relationship among the difference in height between the face center portion and the edge portion of the effective screen in the inner surface of the face portion of a glass panel for a cathode ray tube according to the embodiment of the invention, the thickness of the face center portion, and the weight of the glass panel.

FIG. 2 is a graph showing the relationship between the thickness of the face center portion and the weight of the glass panel for various differences in height H, which is intended to maintain a predetermined mechanical strength, that is, an atmospheric strength for five minutes at 0.34 MPa in a glass panel which has an effective screen size D of 760 mm and an average radius of curvature R of 100000 mm in all the directions of the diagonal, major, and minor axes on the outer surface of the face portion.

In FIG. 2, samples of the embodiment of the invention are indicated by open circles (○), samples of a prior art are indicated by open triangles (Δ), and a sample of a comparative art is indicated by open squares (□), in which the difference in height H is extremely increased. When the values of each sample are approximated using a polynomial, the weight of the glass panel becomes to be minimum value 25.0 kg at H=11.2 mm. On the other hand, when H becomes to be equal to 17 mm or more, as the comparative art sample (□), the weight cannot be made less in comparison with the prior art samples (Δ).

Additionally, among the samples of the embodiment, a glass panel having the minimum thickness of 13.1 mm at the face center portion was formed of a glass having an X-ray absorption coefficient of 30.8 $cm^{-1}$ at a wavelength of 0.06 nm to fabricate a cathode ray tube. When a tube voltage of 37.5 kV was applied to the cathode ray tube, an X-ray leakage dosage thereof was found to be 12 pA/kg which sufficiently satisfied the aforementioned condition of 36 pA/kg. From the t and D of this glass panel, the A can be determined such that $A \geqq 1750\ t/D = 30.2$.

As a comparative art, a glass panel having the same shape was formed of a glass having an X-ray absorption coefficient of 28.5 $cm^{-1}$ at a wavelength of 0.06 nm to fabricate a cathode ray tube. When a tube voltage of 37.5 kV was applied to the cathode ray tube, an X-ray leakage dosage thereof was found to be 244 pA/kg which did not satisfy the aforementioned condition of 36 pA/kg.

Figure 3:
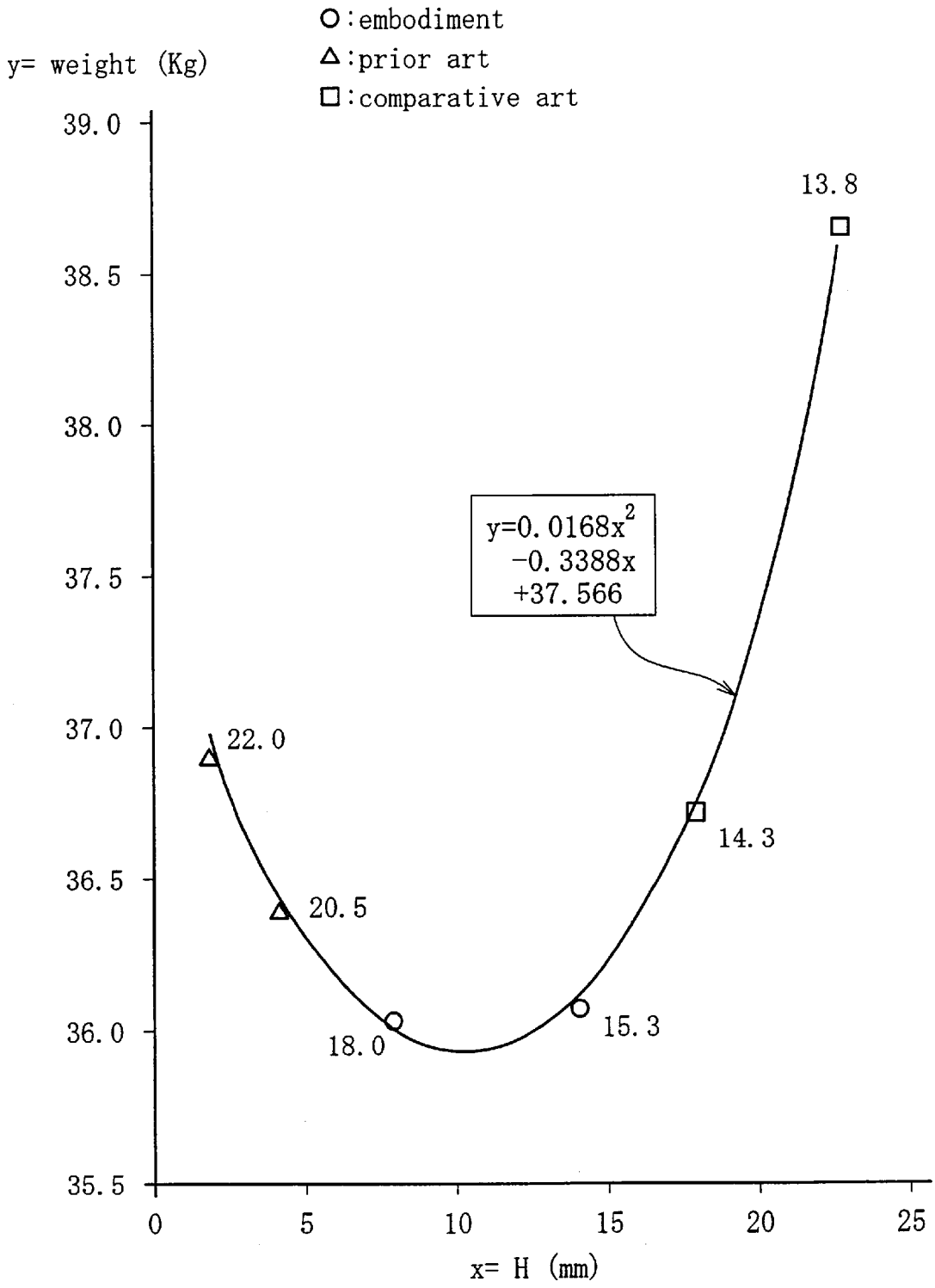
FIG. 3 is an explanatory graph showing the relationship among the difference in height between the face center portion and the edge portion of the effective screen in the inner surface of the face portion of a glass panel for a cathode ray tube having another size according to the embodiment of the invention, the thickness of the face center portion, and the weight of the glass panel.

FIG. 3 is a graph showing the relationship between the thickness of the face center portion and the weight of the glass panel for various differences in height H, which is intended to maintain a predetermined mechanical strength, that is, an atmospheric strength for five minutes at 0.34 MPa in a glass panel which has an effective screen size D of 860 mm and an average radius of curvature R of 100000 mm in all the directions of the diagonal, major, and minor axes on the outer surface of the face portion.

In FIG. 3, samples of the embodiment of the invention are indicated by open circles (○), samples of a prior art are indicated by open triangles (Δ), and a sample of a comparative art is indicated by open squares (□), in which the difference in height H is extremely increased. When the values of each sample are approximated using a polynomial, the weight of the glass panel becomes to be minimum value 35.8 kg at H=10.1 mm. On the other hand, when H becomes to be equal to 17 mm or more, as the comparative art sample (□), the weight cannot be made less in comparison with the prior art samples (Δ).

Additionally, among the samples of the embodiment, a glass panel having the minimum thickness of 15.3 mm at the face center portion was formed of a glass having an X-ray absorption coefficient of 32.1 $cm^{-1}$ at a wavelength of 0.06 nm to fabricate a cathode ray tube. When a tube voltage of 38.0 kV was applied to the cathode ray tube, an X-ray leakage dosage thereof was found to be 7 pA/kg which sufficiently satisfied the aforementioned condition of 36 pA/kg. From the t and D of this glass panel, the A can be determined such that $A \geqq 1750\ t/D = 31.1$.

As a comparative art, a glass panel having the same shape was formed of a glass having an X-ray absorption coefficient of 28.5 $cm^{-1}$ at a wavelength of 0.06 nm to fabricate a cathode ray tube. When a tube voltage of 37.5 kV was applied to the cathode ray tube, an X-ray leakage dosage thereof was found to be 1687 pA/kg which did not satisfy the aforementioned condition of 36 pA/kg.

Figure 4:
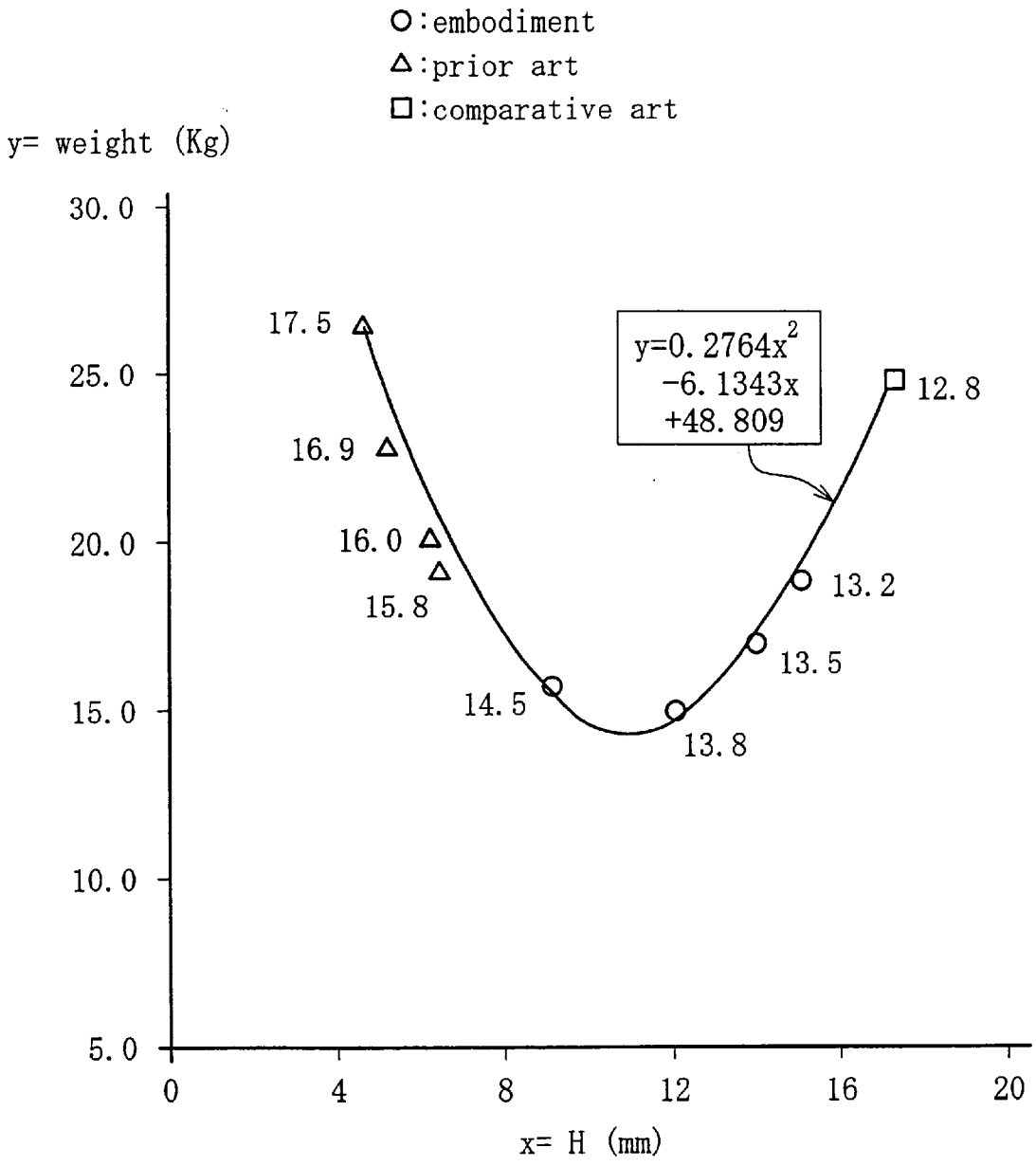
FIG. 4 is an explanatory graph showing the relationship among the difference in height between the face center portion and the edge portion of the effective screen in the inner surface of the face portion of a glass panel for a cathode ray tube having still another size according to the embodiment of the invention, the thickness of the face center portion, and the weight of the glass panel.
Figure 5:
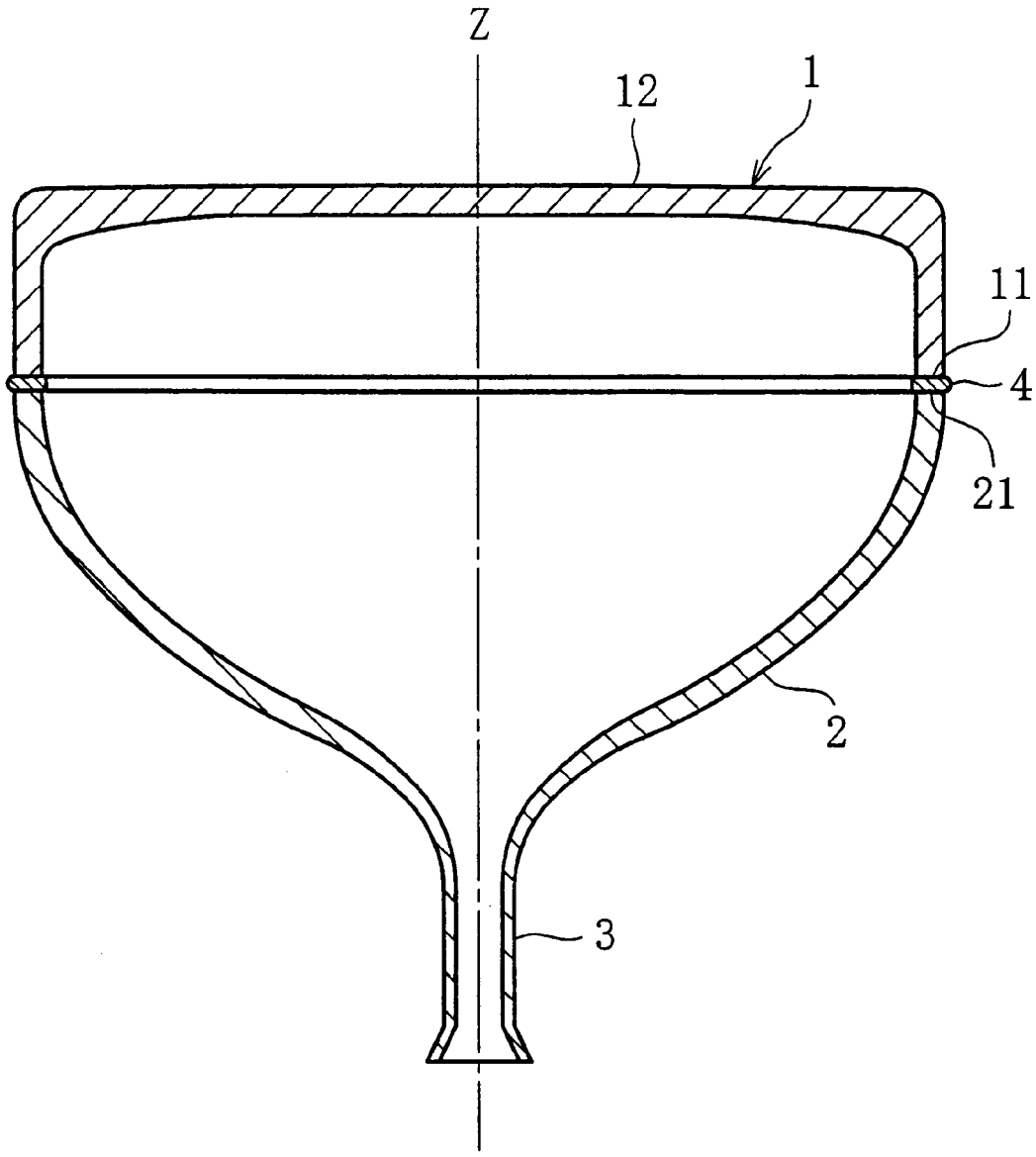
FIG. 5 is an explanatory longitudinal sectional view illustrating a glass bulb for a cathode ray tube.

FIG. 4 is a graph showing the relationship between the thickness of the face center portion and the weight of the glass panel for various differences in height H, which is intended to maintain a predetermined mechanical strength, that is, an atmospheric strength for five minutes at 0.34 MPa in a glass panel which has an effective screen size D of 660 mm and an average radius of curvature R of 100000 mm in all the directions of the diagonal, major, and minor axes on the outer surface of the face portion.

In FIG. 4, samples of the embodiment of the invention are indicated by open circles (○), samples of a prior art are indicated by open triangles (Δ), and a sample of a comparative art is indicated by open squares (□), in which the difference in height H is extremely increased. When the values of each sample are approximated using a polynomial, the weight of the glass panel becomes to be minimum value 14.8 kg at H=11.1 mm. On the other hand, when H becomes to be equal to 17 mm or more, as the comparative art sample (□), the weight cannot be made less in comparison with the prior art samples (Δ).

Additionally, among the samples of the embodiment, a glass panel having the minimum thickness of 13.2 mm at the face center portion was formed of a glass having an X-ray absorption coefficient of 35.0 $cm^{-1}$ at a wavelength of 0.06 nm to fabricate a cathode ray tube. When a tube voltage of 37.0 kV was applied to the cathode ray tube, an X-ray leakage dosage thereof was found to be 16 pA/kg which sufficiently satisfied the aforementioned condition of 36 pA/kg. From the t and D of this glass panel, the A can be determined such that $A \geqq 1750\ t/D = 35.0$.

As a comparative art, a glass panel having the same shape was formed of a glass having an X-ray absorption coefficient of 29.5 $cm^{-1}$ at a wavelength of 0.06 nm to fabricate a cathode ray tube. When a tube voltage of 37.0 kV was applied to the cathode ray tube, an X-ray leakage dosage thereof was found to be 42668 pA/kg which did not satisfy the aforementioned condition of 36 pA/kg.

In each of FIGS. 2 to 4, the numerical values shown in the graph indicate the thickness of the face center portion. In any embodiments, the ratio among the average radii of curvature of the inner surface of the face portion in the directions of the diagonal, major, and minor axes is approximately in the range of (11 to 13):(12 to 14):3. Additionally, on the inner surface of the glass panel, the curved surface from the face center portion to the edge portion of the effective screen may be preferably formed typically with one or two radii so as to make the difference in height therebetween as smooth as possible.

As described above, according to the glass panel for a cathode ray tube of the invention, the difference in height between the face center portion and the edge portion of the effective screen in the diagonal direction on the inner surface of the face portion is provided to fall within the optimum range from 9 mm to 17 mm. This makes it possible to reduce the glass panel in weight while maintaining a predetermined mechanical strength required as a glass panel. Furthermore, the X-ray absorption coefficient of the glass panel was provided to fall within the optimum range in accordance with the shape of a glass panel reduced in weight. This makes it possible to implement a safe glass panel wherein an X-ray leakage from a portion reduced in thickness dose not occur.

What is claimed is:

1. A glass panel for a cathode ray tube comprising:

a substantially rectangular face portion on which images are displayed; and a skirt portion continuous to the face portion through a blend R portion, wherein an effective screen size of the face portion in a diagonal direction is 500 mm or more, wherein an average radius of curvature of an outer surface of the face portion is 10000 mm or more in all radial directions from a face center portion, and wherein a difference in height between the face center portion and an edge portion of the effective screen in the diagonal direction on an inner surface of the face portion is in a range from 9 mm to 17 mm.

2. The glass panel for a cathode ray tube according to claim 1, wherein an X-ray absorption coefficient $A(cm^{-1})$ of the glass panel at a wavelength of 0.06 nm satisfies a condition of $A \geqq 1750\ t/D$, where D (mm) is the effective screen size of the face portion in the diagonal direction, t (mm) is a thickness at the face center portion.

* * * * *